United States Patent [19]

Million

[11] 4,060,216

[45] Nov. 29, 1977

[54] ADJUSTABLE READING MATERIAL SUPPORTER

[76] Inventor: Theodore L. Million, 793 Cambridge Drive, Santa Barbara, Calif. 93111

[21] Appl. No.: 760,003

[22] Filed: Jan. 17, 1977

Related U.S. Application Data

[63] Continuation of Ser. No. 628,483, Nov. 4, 1975, abandoned.

[51] Int. Cl.[2] ..... E01B 7/10

[52] U.S. Cl. ..... 248/460; 248/447; 248/454

[58] Field of Search ..... 248/447, 448, 454, 455, 248/465, 460, 462, 463, 464, 165, 166

[56] References Cited

U.S. PATENT DOCUMENTS

| | | | |
|---|---|---|---|
| 1,026,523 | 5/1912 | Maxwell | 248/460 |
| 1,428,757 | 9/1922 | Coate | 248/462 |
| 1,567,307 | 12/1925 | Taussig | 248/462 |
| 3,007,278 | 11/1961 | Million | 45/85 |

FOREIGN PATENT DOCUMENTS

| | | | |
|---|---|---|---|
| 1,362,630 | 4/1964 | France | 248/460 |

*Primary Examiner*—Robert A. Hafer
*Attorney, Agent, or Firm*—Daniel J. Meaney, Jr.

[57] ABSTRACT

An adjustable reading material supporter including a pair of unitary side members each formed of a vertical back portion terminating in a support end and a base portion terminating in a deflector guide end inclined in a spaced upward and rearward direction relative to said back portion and a rigid elongated back structure having a pair of spaced aligned ends each defining a passageway which rotatably clamps the back portion, one in each end, such that the support ends are on one side of the back structure and the base portions are on the opposite side of the back structure with the position of the guide ends being adjustable relative to the back structure to firmly support reading material between the support ends and back structure at the top and each of the deflector guide ends at the bottom during usage and wherein the position of the base portion and deflector guide ends can be laid substantially flat during storage is disclosed.

10 Claims, 15 Drawing Figures

ADJUSTABLE READING MATERIAL SUPPORTER

This is a continuation of application Ser. No. 628,483, filed Nov. 4, 1975, now abandoned.

BACKGROUND OF THE INVENTION

1. Field of the Invention

This invention relates to a novel and improved adjustable reading material supporter adapted to be placed on a desk, table top, dresser or other suitable flat surface. The supporter is adapted to receive and support reading material such as books, magazines, newspapers or single sheets, in a position convenient for reading, relative to a reader, or for display.

Further, the adjustable reading material supporter of the invention accomodates a wide range of sizes and thicknesses of reading material such as, for example, books of various sizes and thicknesses as well as other reading material such as magazines and newspapers.

2. Description of the Prior Art

Reading stands, book racks, book holders and a wide variety of foldable racks are known in the art. U.S. Pat. No. 3,007,278 discloses a foldable bookholder adapted to support reading material in a position convenient for reading. The book holder disclosed in the patent comprises six elements including a vertically adjustable upper back support member wherein the edges and back structure are co-planar and aligned. An item of reading material is supported by resting the item between the vertically adjustable upper back support and pocket portions formed in forward extending side member. The assembled bookholder utilizes a pair of elongated coupling strips which performs the dual function of pivotally supporting the side members and concurrently forming a receiver or base for the vertically adjustable upper back support.

Other known study stands utilize a rigid fixed back support wherein all back support points are co-planar and aligned. Pocket ends are formed in wire members which are wound in a number of turns coaxially wound around rigid fixed back support such that the pocket ends can be rotated into a folded position for storage and into a support position for usage.

SUMMARY OF THE INVENTION

The adjustable reading material supporter of the present invention is a light weight, sturdy assembled unit adapted to be placed upon a flat surface, such as a study desk or the like, fur supporting reading material in a position convenient for reading or other use, such as for displaying books, magazines or the like.

Upon completion of use, the reading material supporter may be easily folded into a substantially flat planar structure for storage or for convenient transportation.

The adjustable reading material supporter of the present invention has several advantages over the prior art devices. One advantage is that the device is formed of essentially three basic components which are easily assembled into a light weight, convenient, sturdy integral unit. The known prior art devices generally comprise either three or more components or elements which generally are more difficult to assemble.

Another advantage of the present invention over the known prior art devices is the ability of the supporter to provide a sturdy support for a book or other item of reading material while supporting the same in a position which is convenient for reading. The adjustable reading material supporter of the present invention is formed of two identical side members and a single elongated back structure. Each side member is formed of an extended vertical back portion which terminates in a support end. Extending from the vertical back portion is a substantially horizontal base portion which terminates in a deflector guide end. The deflector guide end is inclined in a spaced upward and rearward direction relative to the back portion.

The back structure has two ends each of which is pivotally connected to and essentially is clamped around the back portion of one side member. The side members and back structure are assembled into an integral structure having the support ends in a spaced parallel relationship on one side of the back structure with the base portion being positioned on the other side of the back structure. The integral unit is mechanically stable and is supported by the base portion of the side member.

One unique advantage of the present invention is that the parallel spaced support ends of the side members form two support points extending beyond the back structure. Thus, when an item of reading material is placed on the supporter such as an opened book, the upper portion of the spine of the book engages the back structure while the upper portion of each of the back and front cover, or front pages, if no cover exists, engages the support points. Concurrently, the lower portion of the spine engages the top surface, such as the surface of a study desk, while the lower portion of the opened pages engage and are supported by the deflector guide ends.

The stacked pages of an opened book may be thicker on one side than on the other side. For example, 10 pages of a 300-page book may be positioned on one side and the balance thereof on the other side. The adjustable feature of the present invention permits rotation of one or both of the side members around each pivotal clamped support end of the back structure to afford positioning of the tip of the one or both of the deflected guide ends tightly against the opened pages urging the pages of the book between the guide end and cover into a flat position between the base portion and guide end. Single pages may be turned by sliding the page out from one guide end and slipping that page in between the opposite surface page and the guide end.

The integral structure results in supporting an item of reading material such that the single page or pages facing the user are at less than an 180 ° angle and the item is supported in a convenient natural reading position. The support position is due, in part, to the two support points and the back structure being co-planar to each other but with only the ends of the support ends being in alignment and with the back structure being displaced therebelow.

A BRIEF DESCRIPTION OF THE DRAWING

The above advantages and other advantages will become readily apparent when considered in light of the preferred embodiment described herein taken together with the following drawing wherein.

Figure 1:
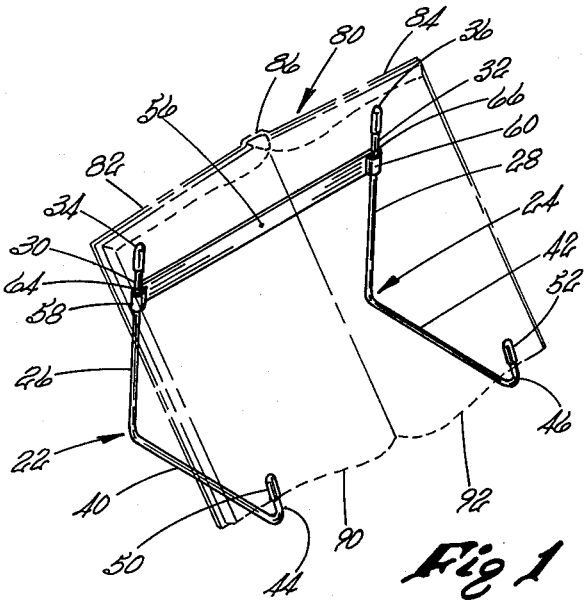
FIG. 1 is an isometric view illustrating an opened book supported on an adjustable reading material supporter embodying the present invention.

Elements shown in various views of the Figures of the drawing which are the same are identified by the same referenced numerals.

DESCRIPTION OF THE PREFERRED EMBODIMENT

The adjustable reading material supporter illustrated in FIG. 1 has a pair of unitary side members 22 and 24. Each side member 22 and 24 includes an extended vertical back portion, 26 and 28 respectively, which terminate in aligned support ends 30 and 32 respectively. Each support end 30 and 32 may have a resilient means such as a fitted plastic tip 34 and 36 respectively, formed thereon.

Each side member 22 and 24 has a substantially horizontal base portion, 40 and 42 respectively, each of which terminates in a deflector guide end, 44 and 46 respectively.

Each deflector guide end 44 and 46 is inclined in a spaced upward and rearward direction relative to its respective back portion 26 and 28. Each deflector guide end 44 and 46 may have a resilient means, such as a fitted plastic tip 50 and 52 respectively.

The third component or element is a rigid elongated back structure 56. The back structure 56 has a pair of spaced aligned ends 58 and 60 each defining a passageway 64 and 66 respectively. The passageway 64 and 66 are of a selected dimension to clamp and pivotally support the extended back portion of a side member.

In FIGS. 1, 2, 3, and 4, the end 58 of back structure 56 clamps and pivotally supports back portion 26 while end 60 clamps pivotally support back portion 28.

The back structure 56 and the side members 22 and 24 are assembled to form an integral structure assembly. The integral assembly has the support ends 30 and 32 extending from one side of the back structure 56 and the horizontal base portion 40 and 42 positioned on the other side thereof. Back portion 26 extends through passageway 64 of end 58 enabling side member 22 to be rotated therearound relative to the clamped pivotal support end 58. Similarly, back portion 28 extends through passageway 66 of end 60 enabling side member 24 to be rotated therearound relative to the clamped pivotal support end 60.

The back portions 26 and 28 are clamped in a substantially spaced planar parallel relationship by ends 58 and 60 respectively. Thus, each side member 22 and 24 can be independently rotated in its respective end 58 and 60.

Referring again to FIG. 1, a bound book illustrated by dashed lines 80 is illustrated with the upper cover portions 82 and 84 thereof resting against the support ends 30 and 32 via plastic tips 34 and 36 respectively. The spine 86 of the book 80 rests against the back structure 56.

The lower portion of the book, designated by 90 and 92, engage and are supported by the deflected guide ends 44 and 46 respectively. Thus, the book is supported between the planar support ends 30 and 32, back structure 56 and deflected guide ends 44 and 46.

Figure 2:
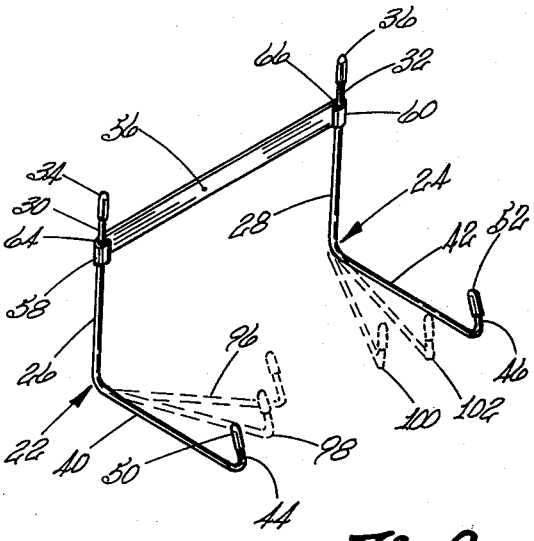
FIG. 2 is an isometric view of the supporter itself with each adjustable side member being shown in several alternate positions.

Referring to FIG. 2, the side members 22 and 24 are adapted to be rotated about pivotal support ends 58 and 60 respectively. Rotation occurs between the vertical back portions 26 and 28 relative to passageways 64 and 66 defined by ends 58 and 60 respectively. The various alternate position of the base portion 40 and 42 and deflected guide ends 44 and 46 are depicted by dashed positions 96 and 98 for base portion 40 and 100 and 102 for base portion 42. The base portions are rotatable to accommodate different sizes and shapes of reading material or to be formed into a relatively planar, compact position for storage.

Figure 3:
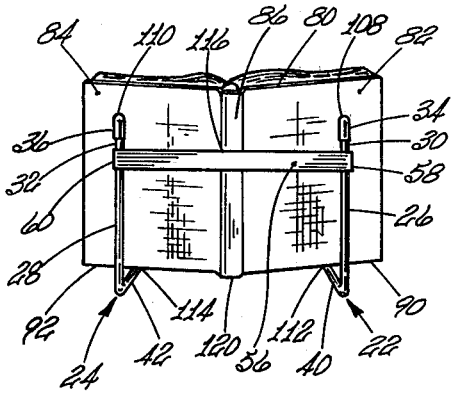
FIG. 3 is an isometric view illustrating the back view of an opened book supported on an adjustable reading material supporter.

FIG. 3 illustrates the points where the adjustable reading material supporter removeably engages and supports the book 80. The upper portions 82 and 84 of book 80 engage support ends 30 and 32 via plastic tips 34 and 36 at support points 108 and 110 respectively. The spine 86 engages the back structure 56 at contact point 116. The lower portion of the cover 90 and 92 engage base portions 40 and 42 at points 112 and 114 respectively. The spine 86 engages the surface upon which the supporter rests at point 116.

Figure 4:
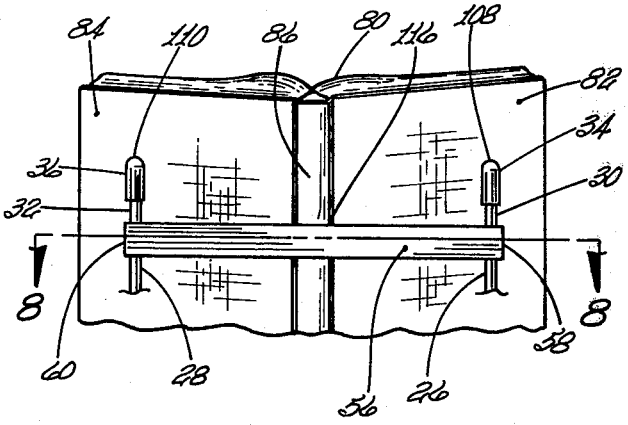
FIG. 4 is an exploded partial isometric back view illustrating the relationship between the upper portion of an opened book and supporter.

FIG. 4 is an exploded view showing the support points 108, 110 and 116 in greater detail. The support ends 30 and 32 and back structure 56 are co-planar. The contact points 108 and 110 are aligned relative to each other. Contact point 116, although co-planar, is not aligned with points 100 and 110. This results in the spline 86 being supported by the back structure 56 in one plane and the cover portions 82 and 84 being supported by the support ends 30 and 32 in a different plane.

Figure 5:
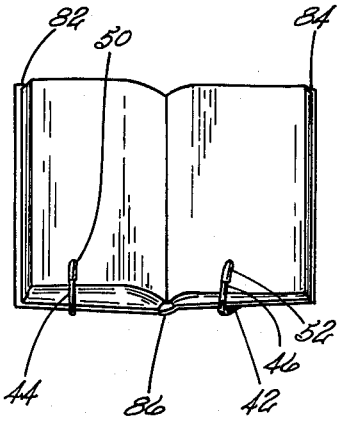
FIGS. 5, 6 and 7 are front views of an opened book supported on an adjustable reading material supporter illustrating the position of the deflector guide ends for various positions of the book pages relative to the covers thereof.
Figure 6:
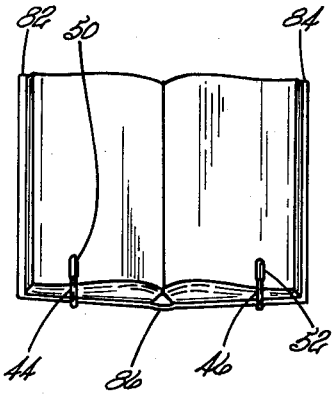
Figure 7:
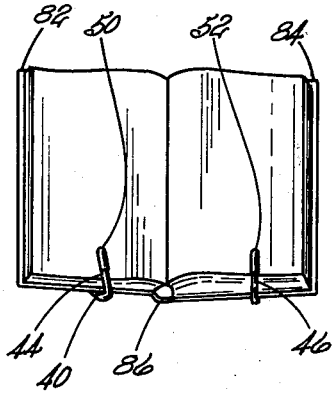

FIGS. 5, 6 and 7 illustrate the adjustable feature of the integral unit to support books in a convenient reading position. FIG. 5 illustrates an arrangement whereby the displayed pages are located at the rear or end of a book. Thus, there are more pages stacked toward cover portion 82. To support the book in this position, guide end 46 is essentially in the position depicted by the dashed line 100 of FIG. 2. However, guide end 46 is positioned toward the spline 86 such that the thin stack of pages can be engaged and supported.

FIG. 6 shows that when the pages of book 80 are fairly evenly distributed to the cover portions 82 and 84, the guide ends 44 and 46 are positioned in about the same relative position to the back structure 56.

FIG. 7 shows the position of guide end 44 when a larger number of pages are positioned toward cover portion 84. The position of guide end 40 is essentially depicted by the dashed line 96 of FIG. 2.

Figure 8:
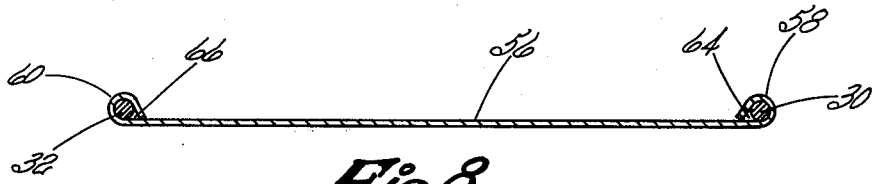
FIG. 8 is a top sectional view taken along line 8—8 in FIG. 4.

FIG. 8 shows clamped pivotal support ends 58 and 60 defined by ends of back structure 52. The back portions 30 and 32 have a circular cross-section. Thus, the passageway 64 and 66 have a geometrical dimension to accomodate the dimension of the back portions 30 and 32. The back structure 56 has a rectangular cross-section. However, it is envisioned that any elongated member with appropriate clamping pivotal support ends may be used. One example may be a tubular back structure formed of a thin-walled circular member having bearing or other apertures formed thereon for receiving and rotatably supporting the side members.

Figure 9:
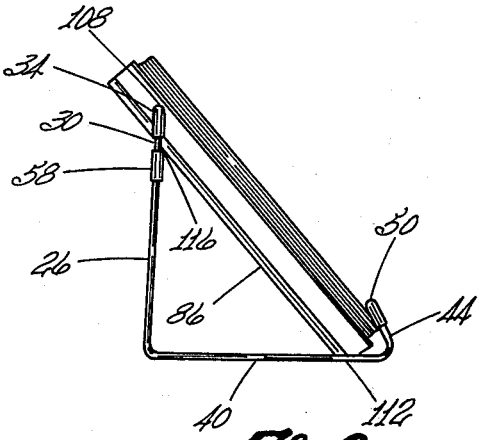
FIGS. 9, 10 and 11 are end views illustrating the support position of a book, newspaper and single sheet respectively.
Figure 10:
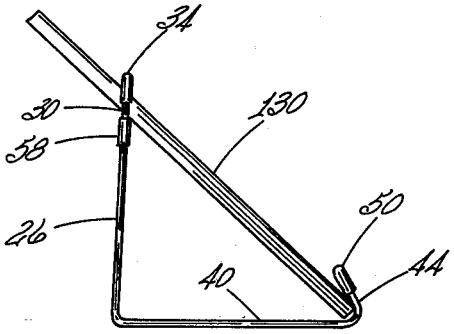
Figure 11:
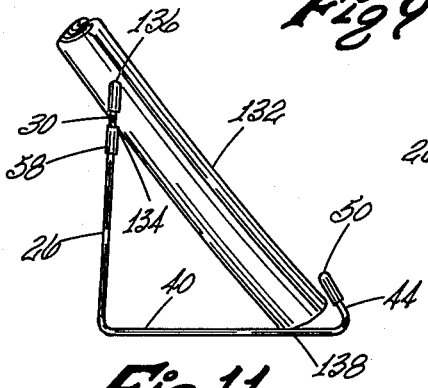

FIGS. 9, 10 and 11 depict an end view of the adjustable reading material supporter supporting a book, folded newspaper and single-sheet respectively. In FIG. 9, book 80 is supported at three points of support 108, 112 and 116. Note that the plastic tip 50 on guide end 44 removeably engages the book page.

FIG. 10 depicts a single sheet of paper 130 which engages back structure 56 and support ends 30 and 32 at the top and guides 44 and 46 at the bottom.

FIG. 11 depicts a newspaper 132 conveniently supported by the supporter. The paper is curved by the two support ends 30 and 32 engaging the paper edge, for example, contact point 136 and the center of the paper engages the back structure 56 at contact point 134. Similarly, the bottom of the paper engages the base portions 40 and 42, such as, for example, contact point 138 on base portion 40. Guide end 44 insures that the bottom of the paper is rigidly supported. The flexed curved paper is rigidly supported by the various support points.

Figure 12:
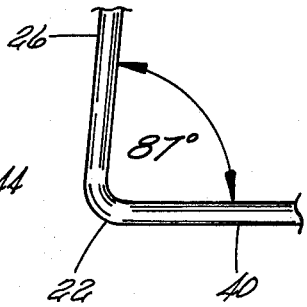
FIGS. 12 and 13 are partial diagrammatic views showing the preferred angle of the disclosed embodiment between the base portion and deflector guide ends respectively.

FIG. 12 illustrates the general angle between the back portion 26 and base portion 40 of side member 22. The magnitude of the angle determines the tilt of the supported reading material to the user. In the preferred embodiment, the angle is about 87°.

Figure 13:
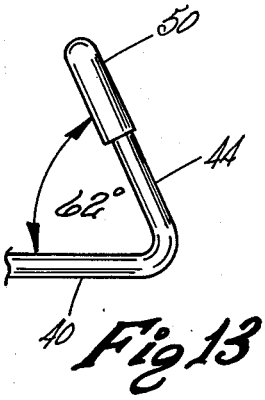

FIG. 13 illustrates the general angle between the base portion 40 and deflector guide end 44 of side member 26. The desired angle is one which permits the plastic tip 50 to yieldably engage the page or pages of the material for support but permits easy removal or insertion of pages while the item of reading material is supported. In the preferred embodiment, the angle is about 62°.

Figure 14:
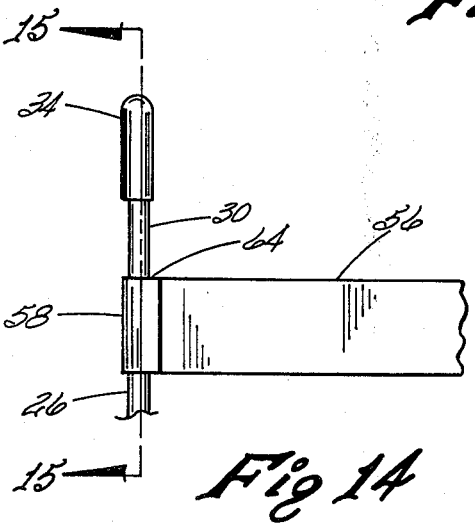
FIG. 14 is an exploded view showing the pivotal clamping support at one end of the back structure having the back portion of the side member extended therethrough.

FIG. 14 is an exploded view of the assembly between the back structure 56 and back portion 26. Back structure 56 terminates in an end 58 which defines a passageway 64 which pivotally clamps and supports back portion 26 while enabling the same to be rotatable therein as described in connection with FIG. 2.

Figure 15:
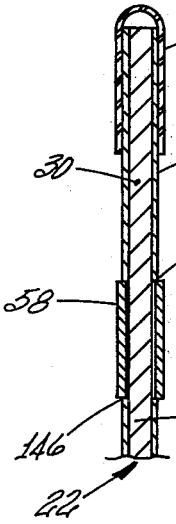
FIG. 15 is a sectional view taken along line 15—15 of FIG. 14.

FIG. 15 is a sectional view showing the surface of the back structure 56 and the surface of base portion 26 and support end 30 with a chrome plating layer 142 having a thickness of a few thousandths of an inch. The chrome plating is accomplished on an assembled unit resulting in a collar 144 and 146 on the exterior of support end 58 which aids in holding the back portion in position while permitting the side member 22 to be rotated.

The integral assembly is formed of three basic components; namely, the pair of side members and the back structure. In the preferred embodiment, the side members are formed of a circular metal wire bent into the desired shape. The back structure is formed of a metal rectangular shaped bar stock with the end thereof curved around and clamped to the exterior of the wire side member. The amount of clamping force is important in that the pressure between the end of the back structure and wire member must be sufficient to hold the back structure in position, but loose enough to permit rotation of the side member with application of a reasonable rotational force. If desired, a drop or two of graphite or oil may be applied to the passageway to provide a limited amount of lubrication.

The physical size of the adjustable reading material supporter is a function of the application. For example, if a large poster size item of reading material is to be supported, then the selected dimensions of the supporter should be of sufficient size to structurally support the item. In addition, the thickness of the plating layer on the assembled unit can be controlled to form guide collars around the ends of the back structure or, in the alternative, the passageway may be defined by preformed ridges or other restrictive means to maintain the relative position of the support end above or below the back structure.

What is claimed is:

1. An adjustable reading material supporter comprising a pair of unitary side members, each side member including an extended vertical back portion terminating in an aligned support end and a substantially horizontal base portion terminating in a deflector guide end inclined in a spaced upward and rearward direction relative to said back portion; and a rigid elongated back structure having a pair of spaced aligned ends each defining a passageway of a selected dimension to clamp and pivotally support the extended vertical back portion of a side member, said back structure and said pair of side members being assembled with the extended vertical back portion of one side member extending through and past one passageway to position the support end of said one side member a spaced distance above and from the elongated back structure and the extended vertical back portion of the other side member extending through and past the other passageway to position the support end of said other side member a spaced distance above and from the elongated back structure forming a three point vertical support comprising each spaced support end of the side members and the elongated back structure with each of the extended vertical back portion being clamped in the passageway in a substantially planar parallel spaced relationship, and with each of the base portions of the side members being located on and equidistant from the same side of the back structure enabling each side member to be independently rotatable 360° within its fixed clamping pivotal support to form an integral structure adapted to support reading material positioned between the support end, back structure and deflector guide ends, said guide ends being capable of being adjusted relative to the reading material by rotation of the side members.

2. The adjustable reading material supporter of claim 1 wherein the cross-section of the side member is circular.

3. The adjustable reading material supporter of claim 2 wherein the cross-section of the back structure is rectangular.

4. The adjustable reading material supporter of claim 2 wherein the angle between the vertical back portion and the horizontal base portion of each side member is about 85°.

5. The adjustable reading material supporter of claim 4 wherein the angle between the base portion and the deflector guide end of each side member is about 67°.

6. The adjustable reading material supporter of claim 3 wherein the clamping pivotal supports are formed by rolling the end of the back structure around the circular-shaped back portion.

7. The adjustable reading material supporter of claim 6 wherein the integral structure is chrome plated to a thickness which forms a collar on each side of each clamping pivotal supporter.

8. The adjustable reading material supporter of claim 6 wherein each side member is adapted to be rotatable into a substantially planar position relative to the back structure.

9. The adjustable reading material supporter of claim 6 wherein each support end and each deflector guide end is terminated in a resilient tip means.

10. A book holder comprising a pair of side members, each side member having an extended vertical back portion terminating in a support end and a substantially horizontal base portion terminating in a deflector guide end, said deflector guide end being inclined in a spaced upward and rearward direction relative to said back portion; and means forming a back structure and defining a fixed passageway for clamping and pivotally supporting the extended vertical back portion of each side member in a predetermined spaced parallel relationship with the support ends thereof being located on and equidistant from said forming means and with the base portions of each side member being located in and equidistant from said forming means and the support end of each side member being located a spaced distance above and from the elongated back structure forming a three point vertical support comprising each spaced support end of the side members and the means forming the back structure, said forming means clamping said back portion of the side member with sufficient force to form an integral structure therefrom while enabling each side member to be independently rotatable 360° for adjusting the position of the deflector guide ends to receive and support a book.

* * * * *